United States Patent [19]

Valiulis

[11] Patent Number: 4,697,712

[45] Date of Patent: Oct. 6, 1987

[54] BRACKET FOR A GRID-TYPE RACK

[75] Inventor: Stanley C. Valiulis, Rockford, Ill.

[73] Assignee: Southern Imperial, Inc., Rockford, Ill.

[21] Appl. No.: 944,860

[22] Filed: Dec. 22, 1986

[51] Int. Cl.[4] ..... A47B 47/00

[52] U.S. Cl. ..... 211/187; 108/107; 108/108; 211/134; 248/225.2; 248/227; 248/243; 248/300

[58] Field of Search ..... 211/187, 134, 189, 59.1; 248/225.2, 227, 220.2, 223.3, 225.31, 243, 250, 263, 200, 247, 248, 274, 300, 301, 304, 316.1; 108/111, 107, 108, 109

[56] References Cited

U.S. PATENT DOCUMENTS 884,772 4/1908 Sorensen ..... 248/225.31 X 2,964,199 12/1960 Portner ..... 248/227 X 4,154,419 5/1979 Breidenbach ..... 211/187 X 4,226,193 10/1980 Gindel ..... 108/111

4,316,593 2/1982 Miner et al. ..... 248/250

*Primary Examiner*—Ramon O. Ramirez

*Attorney, Agent, or Firm*—Leydig, Voit & Mayer

[57] ABSTRACT

A bracket for attaching a grid type rack to a vertical standard having vertically spaced slots therein. The bracket comprises a plate and a clamping member, the plate being formed with a hook adapted to be inserted into one of the slots. The clamping member is secured releasably to the plate by a screw and is formed with angularly spaced curls which loop around rods of the grid-type rack to hold the rack, the plate and the clamping member in tightly assembled relation when the screw is tightened.

18 Claims, 6 Drawing Figures

BRACKET FOR A GRID-TYPE RACK

BACKGROUND OF THE INVENTION

This invention relates generally to a bracket and, more particularly, to a bracket for attaching a grid-type display rack to a vertical member having a series of vertically spaced slots formed therein.

In commercial merchandise displays for hardware stores, drug stores and the like, it has become conventional to locate vertically spaced display shelves at the entrance ends of check out counters or at the ends of the long banks of shelves which extend along the main aisles of the store. The end display shelves usually are supported by cantilevered brackets which, in turn, are detachably hooked into laterally spaced vertical standards having vertically spaced slots to enable the end shelves to be adjustably positioned at selected elevations.

In order to provide still further display capacity, vertically extending grid-type racks often are located at the ends of the end shelves. Such racks are formed by several horizontally extending and vertically spaced rods whose ends are connected by vertically extending rods. Hangers, hooks or trays are hung on the horizontally extending rods and serve as a means for displaying additional merchandise.

In some instances, the grid-type racks are supported from the same slotted standards which support the cantilevered brackets for the end shelves. In many cases, the brackets for attaching a grid-type rack to the standards form a permanent part of the rack itself. Such brackets cannot be flexibly positioned on the rack and thus can interfere with desired positioning of the end shelves. In addition, the rack and the brackets must be sold as a custom unit.

SUMMARY OF THE INVENTION

The general aim of the present invention is to provide a new and relatively simple and inexpensive bracket which may be attached easily and securely to a standard grid-type rack at any desired elevation and which enables the rack to be attached quickly and rigidly to a slotted supporting standard.

A more detailed object of the invention is to achieve the foregoing by providing a two-piece bracket which uniquely utilizes the horizontal and vertical rods of the rack to enable the bracket to be clamped very rigidly to the rack at any selected elevation.

A further object of the invention is to provide bracket means which support the rack solidly and at multiple points from the slotted standard and which may be easily adjusted to conform to the vertical spacing between the slots of the standard.

Still another object is to provide a bracket whose parts may be inexpensively stamped and formed from sheet metal.

The invention also resides in the unique construction enabling the same bracket to be used either in a left-hand or a right-hand installation.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
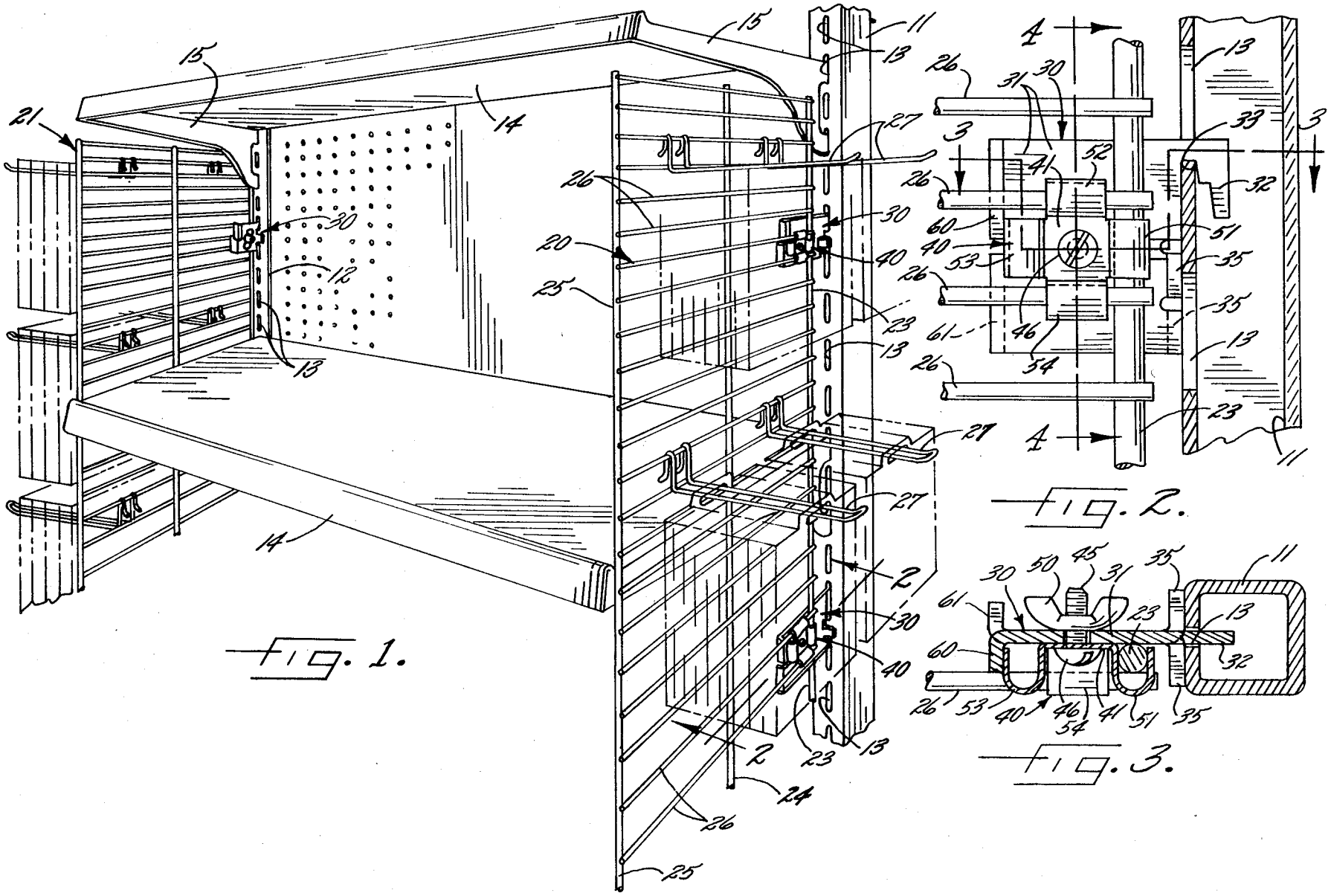
FIG. 1 is a fragmentary perspective view of a typical merchandise display arrangement having grid-type racks which are supported by new and improved brackets incorporating the unique features of the present invention.
FIG. 2 is an enlarged fragmentary cross-section taken substantially along the line 2—2 of FIG. 1.
FIGS. 3 and 4 are fragmentary cross-sections taken substantially along the lines 3—3 and 4—4, respectively of FIG. 2.

For purposes of illustration, the present invention is shown in the drawings in connection with a merchandising display system of the type used by retail stores. The particular system which has been shown comprises a pair of laterally spaced and vertically extending standards 11 and 12 which are secured rigidly in place at the end of a counter or the like. In the present instance, each standard is in the form of an elongated tubular metal member of rectangular cross-section and having a plurality of vertically spaced and vertically elongated holes or slots 13 formed in its outer side. The standards are shown as supporting vertically spaced display shelves 14 having laterally spaced brackets 15 which are hooked into the slots in a conventional manner.

In order to provide additional display capacity, vertically extending grid-type display racks 20 and 21 are located at the right and left ends, respectively, of the shelves 14 and extend at right angles to the standards 11 and 12, respectively. Herein, each rack comprises inner, intermediate and outer vertically extending rods 23, 24 and 25 made of heavy round wire stock. Horizontally extending and vertically spaced rods 26 of a smaller diameter span and overlap the outboard sides of the vertical rods and are welded or otherwise rigidly fixed to the vertical rods. Hangers 27 may be hooked over the horizontal rods at various locations and are used to support merchandise as shown in phantom lines in FIG. 1.

The present invention contemplates the provision of new and improved brackets 30 which may be attached easily to the racks 20 and 21 at any desired elevation and which serve to attach the racks securely but detachably to the standards 11 and 12. The brackets are further characterized in that each bracket may be used universally with either a right-hand rack 20 or with a left-hand rack 21.

Each rack 20, 21 is equipped at least with one upper bracket 30 and one lower bracket. All of the brackets are of identical construction. Accordingly, only one bracket will be described in detail, that being the lower bracket 30 for the right-hand rack 20. As shown in FIGS. 2 and 3, that bracket comprises a generally rectangular flat plate 31 stamped from relatively heavy sheet metal and disposed in a vertical plane. Formed integrally with and projecting inwardly from the corner of the inner and upper edges of the plate in the plane thereof is a hook 32 which extends downwardly in inwardly spaced relation with the upper portion of the inner edge of the plate.

Figure 5:
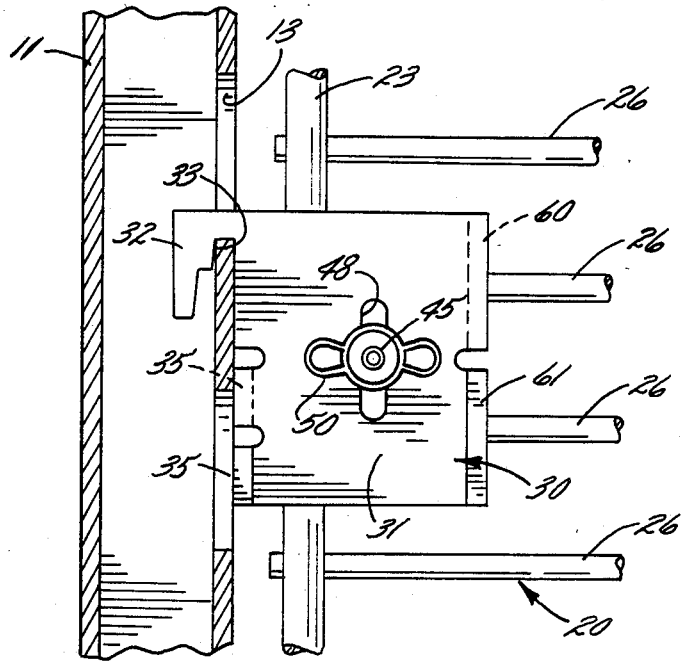
FIG. 5 is a fragmentary cross-section taken substantially along the line 5—5 of FIG. 4.
Figure 6:
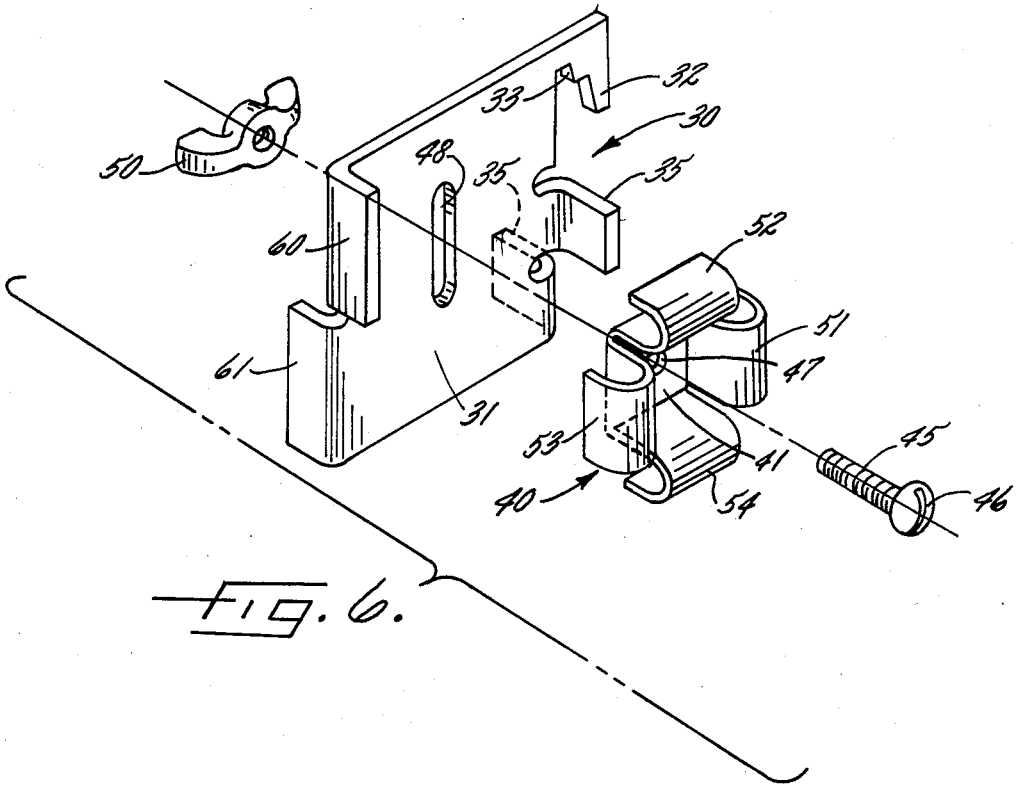
FIG. 6 is an exploded perspective view of the bracket of the invention.

The hook 32 is adapted to extend into any selected one of the slots 13 in the standard 11 and enables the plate 31 to hang from the standard. As shown most clearly in FIGS. 2 and 6, a downwardly opening U-shaped notch 33 is located adjacent the hook and its edges closely embrace the metal of the standard below the lower end of the slot 13. When the plate 31 is attached to the standard 11, the inner edge of the plate engages the outer side of the standard (see FIGS. 2 and 5). To prevent lateral swinging of the plate relative to the standard, two vertically spaced tabs 35 are bent outwardly from the lower end portion of the plate adjacent the inner edge thereof. The tabs extend in laterally opposite directions and are disposed in face-to-face relation with the outer side of the standard 11 so as to stabilize the plate against lateral swinging.

As shown most clearly in FIG. 3, the outboard face of the plate 31 engages and extends outwardly past the inboard side of the inner vertical rod 23 of the rack 20. In keeping with the invention, provision is made of a unique clamping member 40 which coacts with the inner vertical rod 23 and with two adjacent horizontal rods 26 of the rack to fasten the plate 31 securely to the rack.

More specifically, the clamping member 40 is a single piece stamping made of relatively thin gage sheet metal and is formed with a flat central web 41 which is square in shape. The web 41 is sized to fit between two adjacent horizontal rods 26 of the rack 20 and is adapted to lie in face-to-face relation with the outboard face of the plate 31. The clamping member 40 and the plate 31 are adapted to be secured to one another by a fastener or screw 45 having a head 46 which engages the outboard face of the web 41. The shank of the screw extends through a circular hole 47 (FIG. 6) in the web and through a vertically elongated slot 48 in the plate. A wing nut 50 is threaded onto the screw and, when tightened, bears against the inboard face of the plate 31 to clamp the latter to the web 41.

Pursuant to the invention, angularly spaced curls of generally U-shaped cross-section are formed integrally with at least three and preferably all four margins of the web 41 of the clamping member 40. Herein, there are four curls respectively designated by the reference numerals 51, 52, 53 and 54 and defining a square array of curls. Each curl has an initial portion joined to the margin of the web 41 and extending away from the outboard face of the web, a curved intermediate portion extending away from the initial portion, and a terminal portion extending oppositely of the initial portion. The spacing between the initial and terminal portions of each curl is just slightly larger than the diameter of the inner vertical rod 23 of the rack 20. Opposing curls are spaced from one another by a distance corresponding to the vertical spacing between adjacent horizontal rods 26.

Figure 4:
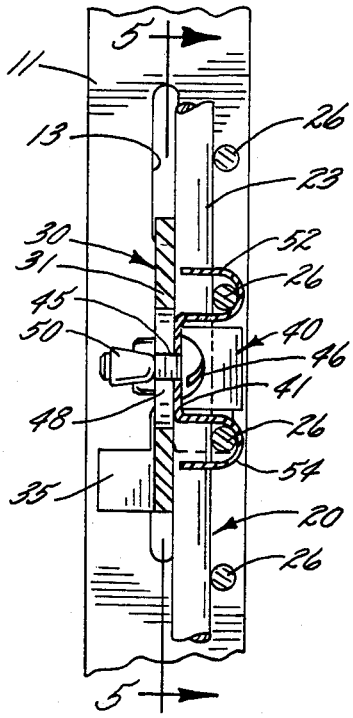

With the foregoing arrangement, the clamping member 40 is assembled with the rack 20 and the plate 31 in the manner shown clearly in FIGS. 2 to 4. When the components are so assembled, the curls 52 and 54 loop partially around adjacent horizontal rods 26 of the rack while the curl 51 is located between such rods and loops partially around the inner vertical rod 23. When the nut 50 is tightened on the screw 45, the curls 52 and 54 are drawn into clamping engagement with the outboard sides of the horizontal rods 26 which are received within such curls (see FIG. 4). As a result, the rack 20, the plate 31 and the clamping member 40 all are secured together as a unit. The lower side of the inside surface of the curl 52 engages the uppermost rod 26 of the pair of adjacent horizontal rods while the upper side of the inside surface of the curl 54 engages the lower horizontal rod of the pair (see FIG. 4). As a result of such engagement, the bracket 30 is restricted against vertical movement relative to the rack 20. In addition, the inside surface of the innermost curl 51 engages the inner and outer sides of the inner vertical rod 23 to restrict inward and outward movement of the bracket relative to the rack. While the curl 53 does not perform any substantial holding function and could be omitted, its presence provides a symmetrical appearance to the clamping member 40 and tends to insure that the clamping member and the plate are always assembled in such a manner that a curl is looped around the inner vertical rod 23.

To further insure tight clamping of the rack 20, the plate 31 and the clamping member 40, a flange 60 (FIGS. 3 and 6) is formed integrally with the outer margin of the plate and extends laterally outwardly therefrom. The length of the flange is equal to the diameter of the inner vertical rod 23 and thus, when the screw 45 is tightened, the free edge of the flange 60 is drawn into clamping engagement with the inboard side of a horizontal rod 26. Such engagement together with engagement of the outboard side of the plate 31 with the inboard side of the inner vertical rod 23 effects a solid two point contact of the plate with the rack 20 to prevent the plate from rocking laterally about the rod 23. In addition, the flange 60 engages the curl 53 (see FIG. 3) to help prevent relative inward and outward movement between the plate 31 and the clamping member 40.

A flange 61 (FIGS. 3 and 5) similar to the flange 60 is formed immediately below the latter and extends from the inner edge of the plate 31 in a direction laterally opposite of the flange 60. The flange 61 performs a function identical to the flange 60 when the bracket 30 is used with a left-hand rack 21 as shown at the left side of FIG. 1.

With the foregoing arrangement, at least two vertically spaced brackets 30 are assembled loosely with the rack 20 by connecting the plate 31 and the clamping member 40 of each bracket to the rack with the screw 45 and the nut 50 while leaving the screw short of full tightening. The hooks 32 of the brackets then are inserted into vertically spaced slots 13 in the standard 11 and, during such insertion, the vertically elongated slots 48 in the plates 31 allow the plates to be adjusted vertically relative to the rack and the clamping members 40. This allows the hooks 32 to be inserted horizontally into the slots 13 and then moved downwardly until the notches 33 bottom against the lower edges of the slots. Thereafter, the screw 45 of each bracket 30 is tightened fully to anchor the rack 20, the plate 31 and the clamping member 40 rigidly together as a unit. In the finally installed position of the bracket, the tabs 35 prevent lateral swinging of the bracket relative to the standard 11; the curls 52 and 54 restrict upward and downward movement of the rack relative to the bracket; the curl 51 restricts inward and outward movement of the rack relative to the bracket; and the plate 31 and the flange 60 coact with the inner vertical rod 23 and a horizontal rod 26 to restrict lateral swinging of the rack relative to the bracket.

Identical brackets 30 may be used on the inboard side of the left rack 21 to fasten the latter to the standard 12. In such an instance, the flange 61 of each bracket engages a horizontal rod of the rack.

I claim:

1. A bracket comprising a generally flat plate having first and second sides and having first and second opposite edges, a hook formed integrally with said plate and projecting from said first edge, a clamping member having a web disposed in face-to-face relation with the first side of said plate, a plurality of angularly spaced curls of generally U-shaped cross-section formed integrally with said web, each of said curls having an initial portion joined to said web and extending away from said first side of said plate, having a curved intermediate portion extending outwardly from said initial portion and having a terminal portion extending back toward said first side of said plate, and a threaded fastener extending through said web and said plate and adapted to be tightened to secure said clamping member to said first side of said plate.

2. A bracket as defined in claim 1 in which said web is generally rectangular, there being curls located adjacent at least three margins of said web.

3. A bracket as defined in claim 2 in which a curl also is located adjacent the fourth margin of said web, said curls being positioned in a generally rectangular array.

4. A bracket as defined in claim 1 further including a flange projecting from and extending generally perpendicular to said first side of said plate adjacent said second edge of said plate.

5. A bracket as defined in claim 4 further including a second flange projecting from and extending generally perpendicular to said second side of said plate adjacent said second edge of said plate, said flanges being spaced from one another along said second edge.

6. A bracket as defined in claim 1 further including first and second tabs formed integrally with said plate and spaced from one another and from said hook along said first edge of said plate, said first and second tabs projecting from and extending generally perpendicular to said first and second sides, respectively, of said plate.

7. A bracket as defined in claim 1 in which an elongated slot is formed through said plate and extends generally parallel to said first and second edges, said slot receiving said fastener and permitting selective edgewise adjustment of said plate relative to said clamping member when said fastener is loosened.

8. A bracket comprising a generally flat and rectangular plate having first and second sides, having first and second opposing edges and having third and fourth opposing edges, a hook formed integrally with said plate adjacent the junction of said first and third edges and extending alongside a portion of said first edge in spaced relation therefrom, said hook being disposed substantially in the plane of said plate, a clamping member having a center web disposed in face-to-face relation with the first side of said plate, said web being generally flat and square and being spaced inwardly from the edges of said plate, four angularly spaced curls of generally U-shaped cross-section formed integrally with the four margins of said web and defining a generally square array of curls, each of said curls having an initial portion joined to a margin of said web and extending away from the first side of said plate, having a curved intermediate portion extending outwardly from said initial portion and toward an edge of said plate and having a terminal portion extending from said intermediate portion and back toward said first side of said plate, a flange formed integrally with, projecting from and extending generally perpendicular to said first side of said plate adjacent said second edge of said plate, first and second tabs formed integrally with said plate and spaced from one another and from said hook along said first edge of said plate, said first and second tabs projecting from and extending generally perpendicular to said first and second sides, respectively, of said plate, and a threaded fastener extending through said web and said plate and adapted to be tightened to secure said clamping member securely to said first side of said plate.

9. A bracket as defined in claim 8 further including a second flange projecting from and extending generally perpendicular to the second side of said plate adjacent said second edge of said plate, said flanges being spaced from one another along said second edge.

10. A bracket as defined in claim 9 in which an elongated slot is formed through said plate and extends generally parallel to said first and second edges, said slot receiving said fastener and permitting selective edgewise adjustment of said plate relative to said clamping member when said fastener is loosened.

11. A bracket for fastening a grid-type rack releasably to and extending outwardly at a right angle from an upright member having vertically spaced holes therein, said rack comprising an inner vertical rod and further comprising a series of horizontal rods fastened to, extending outwardly from and spaced vertically along said vertical rod, said horizontal rods having end portions overlapping one laterally facing side of said vertical rod, said bracket comprising an upright plate having one side adapted to lie against the opposite laterally facing side of said vertical rod in laterally spaced relation with said horizontal rods, said plate having inner and outer edges, a hook formed integrally with the inner edge of said plate and sized to enter one of said holes in said upright member to attach said plate releasably to said upright member, and means for clamping said plate to said rack, said clamping means comprising a clamping member having a center web positioned between two adjacent horizontal rods in face-to-face engagement with said one side of said plate, a vertical curl of generally U-shaped cross-section formed integrally with and projecting from said web, said vertical curl being looped partially around said one laterally facing side of said vertical rod and being positioned between said two adjacent horizontal rods, a pair of vertically spaced horizontal curls of generally U-shaped cross-section formed integrally with and projecting from said web, said horizontal curls being looped partially around said two adjacent horizontal rods, and releasable fastening means extending between said web and said plate and adapted to be tightened to clamp said web to said plate and to clamp said horizontal curls to said two adjacent horizontal rods.

12. A bracket as defined in claim 11 further including a flange projecting laterally from the outer edge of said plate and engageable with one of the horizontal rods of said rack to hold said plate in laterally spaced relation with said rods.

13. The combination of, an upright member having an outer side with vertically spaced and vertically elongated slots therein, a grid-type rack, and a bracket for fastening said rack releasably to said upright member in outwardly extending relation therefrom, said rack comprising an inner vertical rod having inner and outer sides and having two lateral sides facing oppositely of one another, said rack further comprising a series of horizontal rods fastened to, extending outwardly from and spaced vertically along said vertical rod, said horizontal rods having end portions overlapping one lateral side of said vertical rod, said combination being characterized in that said bracket comprises an upright plate having one side lying against the opposite lateral side of said vertical rod in laterally spaced relation with said horizontal rods, said plate having inner and outer edges and top and bottom edges, a hook formed integrally with said plate adjacent the junction of said inner edge and said top edge and extending downwardly alongside a portion of said inner edge in inwardly spaced relation therefrom, said hook lying in the plane of said plate and extending into one of said slots to attach said plate releasably to said upright member, means for clamping said plate to said rack, said clamping means comprising a clamping member having a center web positioned between two adjacent horizontal rods in face-to-face engagement with said one side of said plate, a vertical curl of generally U-shaped cross-section formed integrally with and projecting laterally from said web, said vertical curl being looped partially around said vertical rod and being position between said two adjacent horizontal rods, a pair of vertically spaced horizontal curls of generally U-shaped cross-section formed integrally with and projecting laterally from said web outwardly of said vertical curl, said horizontal curls being looped partially around said two adjacent horizontal rods, a flange projecting laterally from said plate adjacent the outer edge thereof and engaging at least one of said horizontal rods of said rack, tab means projecting laterally from said plate adjacent the inner edge thereof and below said hook and engaging the outer side of said upright member, and a threaded fastener extending between said web and said plate and adapted to be tightened to clamp said web to said plate and to clamp said horizontal curls to said two adjacent horizontal rods.

14. The combination defined in claim 13 in which said tab means comprise a first tab projecting laterally in one direction from the inner edge of said plate and further comprise a second tab spaced vertically from said first tab and projecting laterally in the opposite direction from the inner edge of said plate.

15. The combination as defined in claim 13 further including a second flange spaced vertically from said one flange and projecting laterally from the outer edge of said plate in a direction opposite of said one flange.

16. The combination as defined in claim 13 in which said clamping member further includes a second vertical curl located adjacent the outer ends of said horizontal curls and located between said two adjacent horizontal rods.

17. The combination as defined in claim 13 further including a second bracket identical to said one bracket and clamped to said rack in vertically spaced relation with said one bracket.

18. The combination as defined in claim 17 in which a vertically elongated slot is formed through the plate of each bracket and receives the fastener of such bracket so as to permit vertical adjustment of the plate relative to the clamping member when the fastener is loosened.

* * * * *